US009314826B2

(12) United States Patent
Kröpfl et al.

(10) Patent No.: US 9,314,826 B2
(45) Date of Patent: Apr. 19, 2016

(54) METHOD FOR THE MANUFACTURE OF AN ALUMINIUM ALLOY PLATE PRODUCT HAVING LOW LEVELS OF RESIDUAL STRESS

(75) Inventors: Ingo Günther Kröpfl, Polch (DE); Alfred Johann Peter Haszler, Vallendar (DE)

(73) Assignee: ALERIS ROLLED PRODUCTS GERMANY GMBH, Koblenz (DE)

( * ) Notice: Subject to any disclaimer, the term of this patent is extended or adjusted under 35 U.S.C. 154(b) by 1310 days.

(21) Appl. No.: 13/143,827

(22) PCT Filed: Jan. 15, 2010

(86) PCT No.: PCT/EP2010/050479

§ 371 (c)(1), (2), (4) Date: Oct. 31, 2011

(87) PCT Pub. No.: WO2010/081889

PCT Pub. Date: Jul. 22, 2010

(65) Prior Publication Data

US 2012/0042995 A1 Feb. 23, 2012

Related U.S. Application Data

(60) Provisional application No. 61/145,258, filed on Jan. 16, 2009.

(30) Foreign Application Priority Data

Jan. 16, 2009 (EP) ..... 09150734

(51) Int. Cl.

| | |
|---|---|
| ***C22F 1/04*** | (2006.01) |
| ***C22F 1/057*** | (2006.01) |
| ***C22F 1/053*** | (2006.01) |
| ***C22F 1/05*** | (2006.01) |
| ***B21B 3/00*** | (2006.01) |
| ***C22C 21/06*** | (2006.01) |
| ***C22C 21/10*** | (2006.01) |
| ***C22C 21/12*** | (2006.01) |
| ***C22F 1/047*** | (2006.01) |

(52) U.S. Cl.

CPC . *B21B 3/00* (2013.01); *C22C 21/06* (2013.01); *C22C 21/10* (2013.01); *C22C 21/12* (2013.01); *C22F 1/047* (2013.01); *C22F 1/053* (2013.01); *C22F 1/057* (2013.01)

(58) Field of Classification Search

IPC ..... B21B 2003/001,3/00; C22F 1/04, 1/057, C22F 1/053, 1/05

See application file for complete search history.

(56) References Cited

U.S. PATENT DOCUMENTS

| | | | | |
|---|---|---|---|---|
| 4,648,913 | A | 3/1987 | Hunt, Jr. et al. | |
| 4,861,391 | A | 8/1989 | Rioja et al. | |
| 5,273,594 | A | 12/1993 | Cassada, III | |
| 5,393,357 | A | 2/1995 | Cho | |
| 5,776,269 | A * | 7/1998 | Farrar et al. | 148/689 |
| 6,027,582 | A | 2/2000 | Shahani et al. | |
| 6,077,363 | A | 6/2000 | Heymes et al. | |
| 6,159,315 | A | 12/2000 | Haszler et al. | |
| 6,406,567 | B1 | 6/2002 | Haszler et al. | |
| 6,569,542 | B2 | 5/2003 | Warner et al. | |
| 2002/0121319 | A1 * | 9/2002 | Chakrabarti et al. | 148/694 |
| 2002/0134474 | A1 * | 9/2002 | Cho | 148/699 |
| 2002/0150498 | A1 | 10/2002 | Chakrabarti et al. | |
| 2002/0157742 | A1 * | 10/2002 | Cho | 148/701 |
| 2005/0006010 | A1 | 1/2005 | Benedictus et al. | |
| 2005/0150578 | A1 | 7/2005 | Bes et al. | |
| 2006/0118217 | A1 * | 6/2006 | Oswald et al. | 148/693 |
| 2006/0151075 | A1 | 7/2006 | Van Der Veen et al. | |
| 2008/0173377 | A1 | 7/2008 | Khosla et al. | |
| 2008/0289728 | A1 | 11/2008 | Bes | |
| 2011/0111081 | A1 | 5/2011 | Chen et al. | |

FOREIGN PATENT DOCUMENTS

| | | | |
|---|---|---|---|
| EP | 1544315 | A1 | 6/2005 |
| FR | 2841264 | A1 | 12/2003 |
| FR | 2876117 | A1 | 4/2006 |
| FR | 2879217 | A1 | 6/2006 |
| GB | 2025818 | A | 1/1980 |
| RU | 2163938 | C1 | 3/2001 |
| RU | 2007116978 | A | 11/2008 |
| RU | 2341585 | C2 | 12/2008 |
| WO | 02052053 | A1 | 7/2002 |
| WO | 2004053180 | A2 | 6/2004 |
| WO | 2004056501 | A2 | 7/2004 |

(Continued)

OTHER PUBLICATIONS

Heinz et al., "New Developments in Aluminium Rolled Products for the Aircraft and Aerospace Industry," ATB Metallurgie, 41(3), 16-23, 2001.

"Residual Stress Alterations via Cold Rolling and Stretching of an Aluminium Alloy", W.E. Nickola, Mechanical Relaxation of Residual Stresses—ASTM STP 993, L. Mordfin, Ed., American Society for Testing and Materials, Philadelphia, 1988, pp. 7-18.

"Laminage—Analyse thermomecanique et applications" P. Montmitonnet—Techniques de l'Ingenieur—M3066, pp. 2-6, Jun. 2013.

(Continued)

*Primary Examiner* — Roy King
*Assistant Examiner* — Janelle Morillo
(74) *Attorney, Agent, or Firm* — Vorys, Sater, Seymour and Pease LLP

(57) ABSTRACT

This relates to a method of the manufacture of a thick gauge aluminum alloy plate having reduced level of residual stress. The method includes (a) providing a solution heat-treated and quenched aluminum alloy plate having a thickness of at least 80 mm, (b) stress-relieving the plate by cold rolling the plate to achieve a reduction in the thickness direction of the plate product in a range of at most 8%.

19 Claims, No Drawings

(56) References Cited

FOREIGN PATENT DOCUMENTS

| | | | |
|---|---|---|---|
| WO | 2006037588 | A1 | 4/2006 |
| WO | 2006037647 | A1 | 4/2006 |
| WO | 2008003503 | A2 | 1/2008 |
| WO | 2008003504 | A2 | 1/2008 |
| WO | 2008003506 | A2 | 1/2008 |
| WO | 2008110269 | A1 | 9/2008 |
| WO | 2009156283 | A1 | 12/2009 |

OTHER PUBLICATIONS

"Development of Residual Stresses in Strip Rolling", R. McC. Baker et al. Trans. AIME, 175 (1948), 337.

"Stress Relief in Aluminium Forgings" R.E. Kleint and F.G. Janney, Light Metal Age, Feb. 1958, p. 14.

* cited by examiner

METHOD FOR THE MANUFACTURE OF AN ALUMINIUM ALLOY PLATE PRODUCT HAVING LOW LEVELS OF RESIDUAL STRESS

CROSS-REFERENCE TO RELATED APPLICATIONS

This application is a §371 National Stage Application of International Application No. PCT/EP2010/050479, filed on Jan. 15, 2010, claiming the priority of both European Patent Application No. 09 150734.3 filed on Jan. 16, 2009 and U.S. Provisional Patent Application No. 61/145,258 filed on Jan. 16, 2009.

FIELD OF THE INVENTION

The invention relates to a method of manufacturing a wrought aluminium alloy thick gauge plate product having a reduced level of residual stress.

BACKGROUND TO THE INVENTION

As will be appreciated herein below, except as otherwise indicated, all aluminium alloy designations refer to the Aluminum Association designations in Aluminium Standards and Data and the Registration Records, as published by the Aluminium Association in 2008.

For any description of alloy compositions or preferred alloy compositions, all references to percentages are by weight percent unless otherwise indicated.

Age-hardenable wrought aluminium alloys are used amongst others for aerospace applications because of their combination of strength, corrosion resistance, and damage tolerance properties. Plates from these products are commonly produced by a process involving casting, forming by means of rolling and/or forging, solution heat treating, quenching of the solution heat treated product, and ageing of the quenched product. The quenching process also leaves high residual stress, which cannot be thermally relieved while maintaining the alloy product's favourable mechanical properties. Therefore, the stresses are relieved or at least reduced by applying a uniform plastic strain, which for rolled plate involves uniaxially stretching in the rolling direction, and when applied on an industrial scale typically from about 1.5% to 3% strain, and followed by ageing which consequently carries the Tx51 temper designation.

In an alternative process the rolled plate is compressed in a forging operation commonly by overlapping steps followed by ageing and consequently carries the Tx52 temper designation. Such a forging operation by compressing of thick plates or blocks is for example disclosed in patent document WO-2004/053180-A2.

The article "Relief of Residual Stresses in a High-Strength Aluminum Alloy by Cold Working" by Y. Altschuler et. al., published in "Mechanical Relaxation of Residual Stresses", ASTM STP 993, L. Mordfin, Ed., American Society for Testing and Materials, Philadelphia, 1988, pp. 19-29, concerns the relief of residual stresses derived from the rapid quenching of 7075 aluminium in the form of sheet of 31.8 mm. It was found that mechanical stress relief in tension is to be preferred to that in compression.

U.S. Pat. Nos. 6,159,315 and 6,406,567 disclose methods of stress relieving solution heat-treated and quenched aluminium alloy plates that includes a combination of a stress-relieving cold mechanical stretch and a stress-relieving cold-compression, the cold stretch being performed in the length direction, and the cold compression being performed in the thickness direction.

U.S. Pat. No. 6,569,542 discloses a structural element made from a 2xxx-series alloy having a thickness of at least 10 mm and treated by solution heat treating, quenching, permanent tension to more than 1.5% permanent deformation by means of stretching, and ageing.

U.S. Pat. No. 6,077,363 discloses an AlCuMg sheet product, said sheet having reduced deflection after machining, and whereby the sheet product has been quenched and stretched.

Aluminium sheet products or thin gauge plate products (less than about 20 mm in thickness) may be stretched or leveled by rolls to improve metal flatness and it might result also in a small reduction of residual stress. Levelling by rolls consists of passing the sheet product between two or more series of parallel rolls placed alternately below and above the sheet, the rolls being nested. The sheet product is then alternately deflected in one direction and then in the other direction to obtain plastic deformation. For thicker gauge products (more than about 20 mm in thickness) there are no industrial machines that can accept these kinds of products without adversely affecting the engineering properties of the plate product. Furthermore, the deformation by means of roll levelling is not sufficiently controllable to achieve reproducible characteristics in relaxation of residual stress after quenching, which is easier with a stretcher than with a roll levelling machine, at least in the case of thicker gauge sheet products.

For conventional industrial scale stretching of plate products (about 20 mm or more), the ends are trapped between two jaws and then a permanent controlled elongation is applied. The stretching machine comprises a fixed head with jaws and a mobile head comprising the other jaws. If the cross-section of the plate product is large (e.g. very thick or very wide or both) the strength of the stretching machine, and in particular the clamping force of the jaws, may be insufficient to achieve the desired stretching degree.

SUMMARY OF THE INVENTION

It is an object of the present invention to provide a method of manufacturing age-hardenable aluminium alloy plate product having a gauge of 80 mm or more and having a reduced level of residual stress.

This and other objects and further advantages are met or exceeded by the present invention concerning a method of the manufacture of an aluminium alloy plate having reduced level of residual stress, said method comprising the steps of a) providing a solution heat-treated and quenched aluminium alloy plate having a thickness of at least 80 mm,
b) stress-relieving said plate prior by cold rolling the plate to achieve a reduction in the thickness direction of the plate product of up to 8% and whereby there is a substantially uniform through thickness deformation lowering the internal stresses originating from the quench operation. Rolling is a continuous deformation process for the reduction of the thickness of a plate product.

The aluminium alloy plate product of more than 80 mm thick has been produced by casting, rolling (either symmetric, asymmetric, or a combination thereof) and/or forging, solution heat treating, quenching, and ageing, and wherein after quenching the plate product has been cold rolled according to this invention to reduce the level of residual stress in the product.

DETAILED DESCRIPTION OF THE PREFERRED EMBODIMENTS

The present invention provides a method for the manufacture of an aluminium alloy plate having reduced level of residual stress, said method comprising a) providing a solution heat-treated and quenched aluminium alloy plate having a thickness of at least 80 mm, and preferably of at least 125 mm, b) stress-relieving said plate by cold rolling the plate to achieve a reduction in the thickness direction of the plate product in a range of up to 8%, preferably in a range of 0.3% to 8%, and more preferably in a range of 0.5% to 6%, and even more preferably in a range of 0.5% to 3%.

It has been found that the through-thickness residual stress profiles were significantly reduced as a result of the through thickness deformation from the cold rolling operation. The reduction in the levels of residual stress were in the same range as would have been achieved in a stretching operation. The method of the invention can be applied to plate products of much larger cross sections than can be handled in a regular stretching operation to achieve a similar effect. Furthermore, as the rolling operation is a continuous operation, there are no restrictions to the length of the plate product other than imposed by the dimensions of the original rolling ingot. Hence, plate products having a length of more than 40 meters can be stress relieved by the method according to this invention.

This finding is contrary to for example the article, and incorporated herein by reference, "Residual Stress Alterations via Cold Rolling and Stretching of an Aluminum Alloy", by W. E. Nickola, published in "Mechanical Relaxation of Residual Stresses", ASTM STP 993, L. Mordfin, Ed., American Society for Testing and Materials, Philadelphia, 1988, pp. 7-18, where it was shown that solution heat-treated, cold-water quenched product which had been cold rolled by a 11.5% reduction lead to a significant increase in the level of residual stress. These stresses were only reduced after a 1.25% cold stretch. This would lead the skilled person towards the teaching that cold rolling of as-quenched aluminium alloy products would significantly increase the level of residual stress in the product.

In an embodiment of the invention the cold rolling to reduce residual stress is carried out following solution heat treatment and quenching and prior to any further artificial ageing operation. Cold rolling after quenching and before ageing is favoured as the required rolling forces can be kept at the lowest practical level.

In an embodiment the method for the manufacture of a plate product includes solution heat treatment and quenching, followed by one of more artificial ageing practices and followed by cooling, and where after the aged and quenched plate product is cold rolled in accordance with the invention to reduce the level of residual stress.

The best properties are achieved when the cold rolling operation according to this invention is carried out at a relatively low strain rate of less than 0.10 $sec^{-1}$. In a more preferred embodiment the strain rate is less than about 0.05 $sec^{-1}$, and more preferably less than about 0.03 $sec^{-1}$. A preferred lower limit would be of at least about 0.006 $sec^{-1}$, and more preferably of at least 0.010 $sec^{-1}$.

A regular cold rolling skin-pass of 1% at thick gauge material, for example of 300 mm, would result in a strain rate of about 0.002 to 0.003 $sec^{-1}$, but also leading to increased levels of residual stress. For a conventional cold rolling operation for a thin plate product of reducing the gauge in a single rolling pass from 10 mm to 9 mm would result in a strain rate of about 1.2 $sec^{-1}$, whereas cold rolling of coil material, for example of about 3 mm, would lead to a strain rate of typically about 0.5 $sec^{-1}$.

Some aluminium alloys show surface markings resulting from localized flow and which appear after light straining, known in the art as Lüder-lines. An advantage of the method according to this invention is that there is no formation of such Lüder-lines as the alloy plate products are subjected to a rolling operation.

The cold rolling operation in accordance with this invention to reduce the level of residual stress in the plate product after quenching is to be carried out at a temperature that strain hardening occurs. This means that the temperature of the plate product is preferably less than about 200° C., preferably less than about 90° C., and more preferably less than about 60° C. such that is ideally carried out in a regular industrial environment at ambient temperature. For the purpose of this invention there is no need or requirement to perform the cold rolling temperature at sub-zero temperatures, e.g. significantly less than 0° C. Cryogenic treatment to stress relieve a product is a different process aimed at different products and is commonly carried out after all major machining has been completed. Cryogenic treatment is considered not to be within the scope of the present invention.

In a preferred embodiment the cold rolling operation in accordance with the invention to reduce the level of residual stress is advantageously carried out in a rolling schedule comprising one or more rolling passes having a total minimum plastic deformation in the thickness direction of at least 0.3%, and preferably of at least 0.5%.

In a preferred embodiment the cold rolling schedule is carried out such that the deformation is introduced in one single rolling operation and not in a multiple-step cold rolling operation.

Following the cold rolling operation to reduce the level of residual stress it is possible to further cold work the plate product in improve the plate flatness. However, a stretching operation or compressing operation is preferably not being carried out.

Where a stretcher machine has considerable limitations to handle large cross sectional plate products, it is now also possible to reduce the level of residual stress in plate products having an increased cross sectional area, for example having a width of about 1200 mm or more. In accordance with this invention the plate product may have a width of 1200 mm or more, and even of about 1500 mm or more. However, it will be evident to the skilled person that regular plate dimensions can be processed with the method according to this invention.

The aluminium plate product has a thickness of 80 mm or more, preferably of about 125 mm or more, and preferably of about 175 mm or more. In accordance with the invention it has been found that plate product of thinner gauge, e.g. 15 mm or 50 mm, when subjected to cold rolling after quenching results in an increase in the level of residual stress. The upper-limit of the plate thickness is in principle only limited by the force of the rolling mill. In practical terms this would mean an upper-limit for the thickness of about 800 mm, and more typically of about 600 mm, and more typically of about 400 mm.

In an embodiment the age-hardening aluminium alloy is selected from the group consisting of 2xxx, 6xxx, or 7xxx-series alloys.

Some particular examples of alloy products favourably processed with the method according to this invention have a chemical composition within the ranges of AA7010, AA7136, AA7040, AA7140, AA7049, AA7050, AA7075, AA7081, AA7181, or AA7085, plus modifications thereof.

The 6xxx-series alloys include amongst other AA6061, AA6082, AA6013, and 6xxx-series alloy modification comprising purposive additions of Zn and/or Li. The 2xxx-series alloys include amongst other AA2014, AA2017, AA2024, AA2124, AA2219, and also 2xxx-series alloy modification thereof comprising purposive additions of Zn and/or Ag and/or Li.

A further aspect of the invention relates to a method of use of the plate product obtained by the method according to this invention for the manufacture of machined structural workpieces, for the manufacture of injection moulds, such as moulds for plastics or rubber, as well as for structural members for airframe structures, such as spars, floor beam members, and wing stringers.

In the following, the invention will be explained by the following non-limitative examples.

EXAMPLE 1

All the AA6061-series aluminium alloy plates had the same dimensions and were cast using the same procedure. They were subjected to a standard transformation sequence for thick gauge products, that is reheating after homogenisation, hot rolling to a gauge of 152 mm, solution heat-treating and quenched. The as-quenched plates were then treated in several different ways to investigate the effect of further processing on the level of residual stresses in the plate material. The cold rolling in accordance with the invention has been carried out on a 160 inch rolling mill.

The following conditions have been tested:

1. As-quenched;
2. As-quenched followed by cold stretching by 2%, and which would be part of a regular Tx51 processing route for this type of alloy products;
3. As-quenched and followed by a cold reduction according with the invention using a strain rate of about 0.016 $sec^{-1}$ and a cold rolling thickness reduction of 3% in two passes;
4. As-quenched and followed by a cold reduction according with the invention using a strain rate of about 0.016 $sec^{-1}$ and a cold rolling thickness reduction of 8% in five passes.

The level of residual stress at mid-thickness (s/2) has been measured in accordance with BMS 7-323 and the results of which have been listed in Table 1.

TABLE 1

The level of residual stress as function of cold rolling deformation operation after quenching.

| Cold rolling practice | Residual stress [MPa] |
|---|---|
| As-quenched | +61 |
| As-quenched + 2% stretching | −2 |
| As-quenched + 3% cold rolling | −78 |
| As-quenched + 8% cold rolling | −91 |

From these results it can be seen that the as-quenched plate product has a high residual stress, whereas the residual stress of the stretched product is around zero as one would expect. The residual stress of the cold rolled products increases with increasing cold rolling degree. This would mean that at relatively low cold rolling degree at low strain rate there might be a residual stress profile closely corresponding to that of stretched products.

EXAMPLE 2

In a further series of industrial scale trials 360 mm plates had been produced up-to as-quenched in an analogue manner as in Example 1, where after the as-quenched plate products were cold rolled in accordance with the invention using a strain rate of about 0.015 $sec^{-1}$, by whereby a variable cold rolling reduction had been applied (all as single rolling pass).

The level of residual stress at mid-thickness (s/2) has been measured in accordance with BMS 7-323 and the results of which have been listed in Table 2.

The results of this series of experiments show that there is a strong influence of the cold rolling degree on the level of residual stress at mid-thickness of a thick gauge plate product. At a too high cold rolling reduction the level of residual stress increases rapidly. That a high level of cold rolling reduction results in high levels of residual stress is what the skilled person knows from for example the above referenced article "Residual Stress Alterations via Cold Rolling and Stretching of an Aluminum Alloy", by W. E. Nickola, published in 1988. However, in accordance with the invention it has been found that at a much lower levels of cold rolling reduction a favourable low degree of residual stress is obtained, which levels are comparable to or are better than those that would be achieved with cold stretching of the thick plate product. This could overcome the need for stress relieving by means of stretching, which is in particular favourable for wide and/or thick products as the capabilities of stretching machines are limited to certain dimensions of the plate products.

TABLE 2

The level of residual stress as function of cold rolling deformation.

| Cold rolling degree (%) | Residual stress [MPa] |
|---|---|
| 0.0% | +39 |
| 1.1% | +5 |
| 1.5% | +10 |
| 2.3% | −21 |
| 4.0% | −35 |

A similar trend in the development of the level of residual stress at mid-thickness has been found for 360 mm plate material of the alloy AA2219.

These industrial scale experiments has been carried out on AA6061 plate material to illustrate the principle of this invention and verified on AA2219 material; however the skilled person will recognize immediately that the same effect can be obtained in other aluminium alloys, such as those of the 7xxx- and 2xxx-series.

The invention is not limited to the embodiments described before, which may be varied widely within the scope of the invention as defined by the appending claims.

The invention claimed is:

1. A method of the manufacture of an aluminium ahoy plate having reduced level of residual stress, said method comprising:

a) providing a solution heat-treated, quenched, artificially aged and cooled aluminium alloy plate having a thickness of at least 80 mm, b) stress-relieving said plate by cold rolling the plate to achieve a reduction in the thickness direction of the plate product in a range of 0.5% to 6%, wherein the cold rolling is carried out after the solution heat treatment, quenching, artificial ageing and cooling and wherein the cold rolling is carried out at a strain rate of 0.006 to 0.10 $sec^{-1}$.

2. A method according to claim 1, wherein said plate is made of an aluminium alloy selected from the group consisting of 2xxx, 6xxx, and 7xxx-series aluminium alloy.

3. A method according to claim 1, wherein said plate has a thickness of less than 800 mm.

4. A method according to claim 1, wherein said plate has a thickness of at least 125 mm.

5. A method according to claim 1, wherein said plate has been cold rolled at a temperature of less than 90° C.

6. A method according to claim 1, wherein the cold rolling during step b) is carried out using a rolling schedule consisting of a single rolling pass.

7. A method according to claim 1, wherein the plate is made from a 7xxx-series aluminium alloy.

8. A method according to claim 1, wherein the plate is made from a 6xxx-series aluminium alloy.

9. A method according to claim 1, wherein the plate is made from a 2xxx-series aluminium alloy.

10. A method according to claim 1, wherein said plate has a thickness of less than 600 mm.

11. A method according to claim 1, wherein said plate has a thickness of at least 175 mm.

12. A method according to claim 1, wherein said plate has been cold rolled at a temperature of less than 60° C.

13. A method according to claim 1, wherein the cold rolling during step b) is carried out at a strain rate of 0.006 to less than 0.05 $sec^{-1}$.

14. A method according to claim 1, wherein the plate is made from a 7xxx-series aluminium alloy selected from the group consisting of AA7010, AA7136, AA7040, AA7140, AA7049, AA7050, AA7075, AA7081, AA7181, and AA7085 aluminium alloy.

15. A method according to claim 1, wherein the plate is made from a 6xxx-series aluminium alloy selected from the group consisting of AA6061, AA6082, and AA6013 aluminium alloy.

16. A method according to claim 1, wherein the plate is made from a 2xxx-series aluminium alloy selected from the group consisting of AA2014, AA2017, AA2024, AA2124, and AA2219 aluminium alloy.

17. A method according to claim 1, wherein in step b) the plate is cold-rolled to achieve a reduction in the thickness direction of the plate product in a range of 0.5% to 3%.

18. A method according to claim 1, wherein in step b) the plate is cold-rolled to achieve a reduction in the thickness direction of the plate product in a range of 1% to 6%.

19. A method according to claim 1, wherein in step b) the plate is cold-rolled to achieve a reduction in the thickness direction of the plate product in a range of 2% to 6%.

* * * * *

UNITED STATES PATENT AND TRADEMARK OFFICE

CERTIFICATE OF CORRECTION

PATENT NO. : 9,314,826 B2
APPLICATION NO. : 13/143827
DATED : April 19, 2016
INVENTOR(S) : Ingo Günther Kröpfl et al.

It is certified that error appears in the above-identified patent and that said Letters Patent is hereby corrected as shown below:

In the claims

In Column 6, line 58, change “ahoy” to --alloy--.

Signed and Sealed this
Twenty-third Day of August, 2016

Michelle K. Lee

Michelle K. Lee
*Director of the United States Patent and Trademark Office*